US008944788B2

(12) United States Patent
Armstrong et al.

(10) Patent No.: US 8,944,788 B2
(45) **Date of Patent: *Feb. 3, 2015**

(54) NET-DISPLACEMENT CONTROL OF FLUID DEVICE

(75) Inventors: Brian Armstrong, Shorewood, WI (US); Qinghui Yuan, Maple Grove, MN (US)

(73) Assignee: Eaton Corporation, Cleveland, OH (US)

( * ) Notice: Subject to any disclaimer, the term of this patent is extended or adjusted under 35 U.S.C. 154(b) by 1 day.

This patent is subject to a terminal disclaimer.

(21) Appl. No.: 13/568,805

(22) Filed: Aug. 7, 2012

(65) Prior Publication Data

US 2013/0058820 A1 Mar. 7, 2013

Related U.S. Application Data

(63) Continuation of application No. 12/067,711, filed as application No. PCT/IB2006/002612 on Sep. 21, 2006, now Pat. No. 8,235,676.

(60) Provisional application No. 60/720,102, filed on Sep. 23, 2005.

(51) Int. Cl.
*F04C 28/24* (2006.01)
*F04C 2/10* (2006.01)
(Continued)

(52) U.S. Cl.
CPC ..... *F04C 14/065* (2013.01); *F03C 2/08* (2013.01); *F04C 2/103* (2013.01); *F04C 14/24* (2013.01)
USPC ..... 418/1; 417/53; 418/61.3; 418/270

(58) Field of Classification Search
CPC ..... F04C 2/105
USPC ..... 417/53, 270; 418/1, 61.3, 171, 270; 91/476
See application file for complete search history.

(56) References Cited

U.S. PATENT DOCUMENTS 3,779,673 A 12/1973 Ahern et al.
4,767,292 A * 8/1988 Kinder ..... 418/2
(Continued)

FOREIGN PATENT DOCUMENTS

DE 196 27 095 4/1997
EP 0 558 921 9/1993

OTHER PUBLICATIONS

International Search Report for International Application No. PCT/IB2006/002612 mailed Jan. 18, 2007.

*Primary Examiner* — Devon Kramer
*Assistant Examiner* — Nathan Zollinger
(74) *Attorney, Agent, or Firm* — Merchant & Gould P.C.

(57) ABSTRACT

Methods for controlling the net-displacement of a rotary fluid pressure device are disclosed. One of the net-displacement control methods (47) includes obtaining a desired input parameter (23) and a relative position (21) of a first member (43) and a second member (35) of a fluid displacement mechanism. A determination of a first and second output value is then made for each of a plurality of volume chambers (45) when the volume chambers (45) are supplied with fluid at fluid inlet and fluid outlet conditions, respectively. A total output value is then computed for each of a plurality of control valve configurations (63) and compared to the desired input parameter (23). The control valve configuration (63) with the total output value most similar to the desired input parameter (23) is then selected. A plurality of control valves (15) are then actuated in accordance with the selected control valve configuration (63).

7 Claims, 9 Drawing Sheets

(51) Int. Cl.

| | |
|---|---|
| ***F04C 14/06*** | (2006.01) |
| ***F03C 2/08*** | (2006.01) |
| ***F04C 14/24*** | (2006.01) |

(56) References Cited

U.S. PATENT DOCUMENTS

| | | | | |
|---|---|---|---|---|
| 5,700,136 | A | 12/1997 | Sturman | |
| 6,681,571 | B2 * | 1/2004 | Bailey et al. | 60/489 |
| 8,192,175 | B2 * | 6/2012 | Kuttler et al. | 417/290 |
| 8,197,224 | B2 * | 6/2012 | Kuttler et al. | 417/53 |
| 8,235,676 | B2 * | 8/2012 | Armstrong et al. | 417/53 |
| 8,292,605 | B2 * | 10/2012 | Yuan et al. | 418/1 |
| 8,348,627 | B2 * | 1/2013 | Rampen et al. | 417/57 |

* cited by examiner

NET-DISPLACEMENT CONTROL OF FLUID DEVICE

This application is a Continuation of U.S. Ser. No. 12/067,711, filed Nov. 14, 2008, which is a National Stage application of PCT/IB2006/002612, filed Sep. 21, 2006, which claims benefit of Ser. No. 60/720,102, filed Sep. 23, 2005 in the United States and which applications are incorporated herein by reference. To the extent appropriate, a claim of priority is made to each of the above disclosed applications.

BACKGROUND OF THE DISCLOSURE

The present invention relates to rotary fluid pressure devices of the type including electromagnetic valves, and more particularly, to a method of controlling the net-displacement of such rotary fluid pressure devices.

Although the present invention can be used in connection with various pump and motor configurations, which contain various types of fluid displacement mechanisms, including but not limited to an axial piston type, a radial piston type, a cam lobe type, and a vane type, it is especially advantageous when used with fluid motors having fluid displacement mechanisms of the gerotor type. Therefore, the present invention will be discussed in connection with fluid motors having fluid displacement mechanisms of the gerotor type without intending to limit the scope of the invention.

Fluid motors of the type utilizing a gerotor displacement mechanism to convert fluid pressure into a rotary output are widely used in a variety of low speed, high torque commercial applications. Typically, in fluid motors of this type, the gerotor mechanism includes a fixed internally toothed member (ring) and an externally toothed member (star) which is eccentrically disposed within the ring and orbits and rotates relative thereto. This relative orbital and rotational movement defines a plurality of volume chambers in the gerotor mechanism that sequentially expand and contract. Typically, fluid is communicated to these volume chambers through conventional valving means, such as spool and disc. These conventional valving means provide fluid communication between the fluid inlet, the fluid outlet, and the volume chambers. During the sequential expansion and contraction of the volume chambers, the fluid inlet is in fluid communication with the expanding volume chambers, while the fluid outlet is in fluid communication with the contracting volume chambers.

In U.S. Pat. No. 4,767,292, a different valving means was described. In the '292 patent, electromagnetic valves provided fluid communication between the fluid inlet and the expanding volume chambers and the fluid outlet and the contracting volume chambers. Therefore, the invention described in the '292 patent utilizes the same sequential pattern of valving as employed by the conventional valving means.

Although valving means which employ this sequential pattern of valving are quite effective and successful in many commercial applications, one of the problems with this type of valving is that it leads to variations in output torque and output speed at constant fluid conditions. In order to improve the workability and comfort during the operation of various off-highway construction and agriculture vehicles, including but not limited to skid-steer loaders, mini-excavators, and air seeders, many manufacturers of such vehicles are now requesting fluid motors which are capable of providing torque and flow outputs with minimal variations at constant conditions.

BRIEF SUMMARY OF THE INVENTION

Accordingly, it is an object of the present invention to provide a method of control for rotary fluid pressure devices that overcomes the above discussed disadvantages of the prior art.

In order to accomplish the above mentioned object, the present invention provides a method for controlling the net-displacement of a rotary fluid pressure devices of the type including a fluid inlet and a fluid outlet, and a fluid energy-translating displacement assembly including a first member and a second member operably associated with the first member. The first member and the second member of the fluid energy-translating displacement assembly move relative to each other and interengage to define a plurality of expanding and contracting volume chambers in response to that relative movement. Each of a plurality of control valves provide selective fluid communication between one of the plurality of volume chambers and the fluid inlet and the fluid outlet, with each control valve being electrically responsive to an electronic signal that is generated by a control means.

The first method for controlling the net-displacement of the rotary fluid pressure device comprises the steps of obtaining a desired input parameter at a present sample time and determining a relative position of the first member and the second member of the fluid energy-translating displacement assembly. A first output value based on the relative position of the fluid energy-translating displacement assembly is then determined for each of the plurality of volume chambers, with each volume chamber being in fluid communication with the fluid inlet. A second output value based on the relative position of the fluid energy-translating displacement assembly is then determined for each of the plurality of volume chambers, with each volume chamber being in fluid communication with the fluid outlet. A total output value is then calculated for each of a plurality of control valve configurations. The total output values are then compared to the desired input parameter. A control valve configuration, with a total output value which is similar to said desired parameter, is then selected. Following this, the control valves are actuated in accordance with the selected control valve configuration.

In order to accomplish the above mentioned object, an alternative method for controlling the net-displacement of rotary fluid pressure devices of the type described above is provided in another embodiment of the present invention. This alternative method for controlling the net-displacement of the rotary fluid pressure device comprises the steps of obtaining a desired input parameter at a present sample time and determining a relative position of the first member and the second member of the fluid energy-translating displacement assembly (as in the first method). The desired input parameter and the relative position of the fluid energy-translating displacement assembly are then used as inputs into a control valve configuration lookup table, from which a control valve configuration is retrieved. The control valves are then actuated in accordance with the selected control valve configuration.

DETAILED DESCRIPTION OF THE PREFERRED EMBODIMENT

Figure 1:
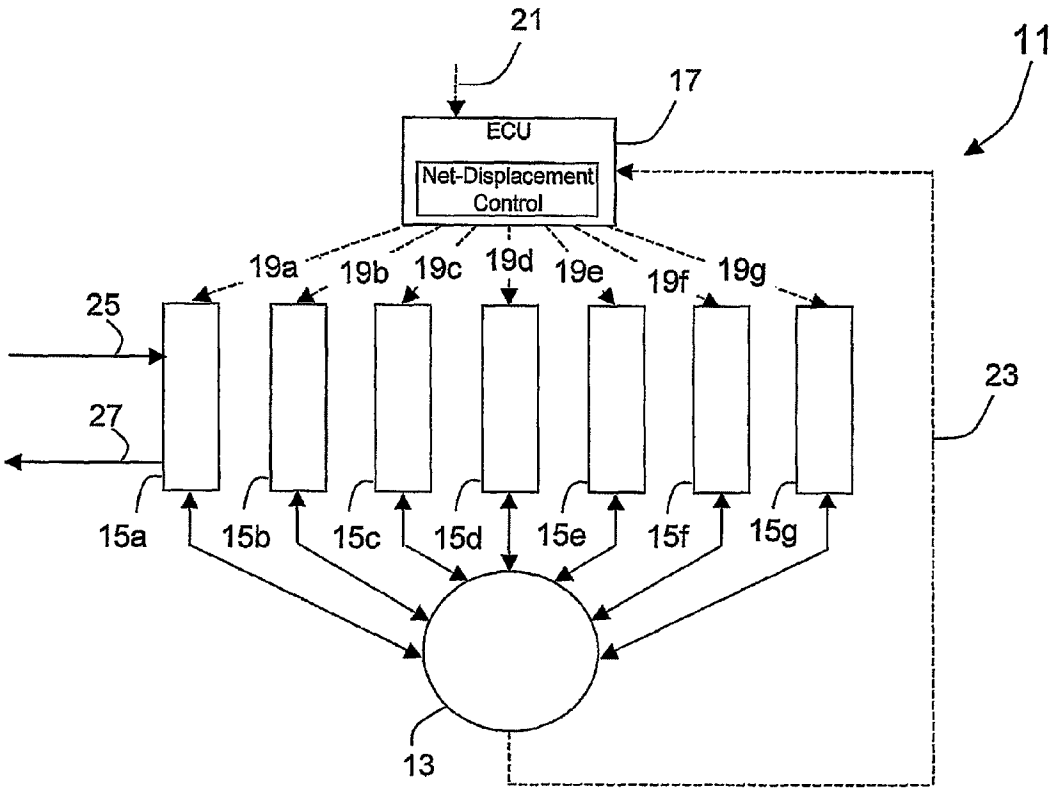
FIG. 1 is a block diagram of an electro-hydraulic system made in accordance with the present invention.

Referring now to the drawings, which are not intended to limit the invention, FIG. 1 is a block diagram of an electro-hydraulic system, generally designated 11. The electro-hydraulic system 11 includes a rotary fluid pressure device 13, a plurality of electrically actuated control valves, generally designated 15, an electronic control unit ("ECU") 17 for outputting a plurality of electrical control signals, generally designated 19, a position input value 21 and a desired input parameter 23, both of which are received by the ECU 17, a fluid inlet 25, and a fluid outlet 27. While the rotary fluid pressure device 13 could be used as either a fluid pump or fluid motor, it will be described in greater detail subsequently as a fluid motor without intending to limit the present invention in any way.

Figure 2:
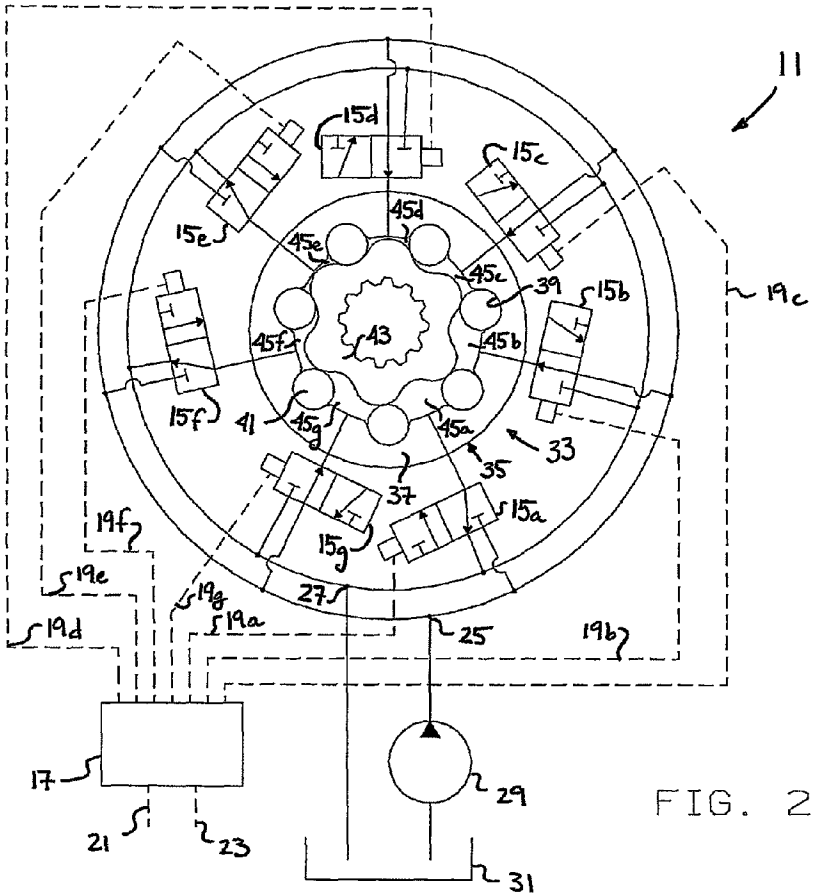
FIG. 2 is a hydraulic schematic of the electro-hydraulic system made in accordance with the present invention.

FIG. 2 is a hydraulic schematic of the electro-hydraulic system 11, in which the rotary fluid pressure device 13 is shown as a fluid motor. The electro-hydraulic system 11 further includes a fluid pump 29, shown herein as a fixed displacement pump, and a reservoir 31. The fluid motor includes a fluid displacement mechanism, generally designated 33, of the gerotor type. It will be understood by those skilled in the art, however, that the present invention is not limited to fluid displacement mechanisms 33 of the gerotor type. The present invention could be used with fluid displacement mechanisms 33 of other types, including but not limited to an axial piston type, a radial piston type, a cam lobe type, or a vane type.

The gerotor displacement mechanism 33 is well known in the art and will therefore be described only briefly herein. More specifically, in the subject embodiment, the gerotor displacement mechanism 33 is a Geroler® displacement mechanism comprising an internally toothed assembly 35, also referred to hereinafter as a "ring assembly". The ring assembly 35 comprises a stationary ring member 37 which defines a plurality of generally semi-cylindrical openings 39. Rotatably disposed within each of the semi-cylindrical openings 39 is a cylindrical member 41, also referred to hereinafter as a "roller". Eccentrically disposed within the ring assembly 35 is an externally toothed rotor member 43, also referred to hereinafter as a "star". In the subject embodiment, and by way of example only, the star 43 has one less tooth than the number of rollers 41, thus permitting the star 43 to orbit and rotate relative to the ring assembly 35. The relative orbital and rotational movement between the ring assembly 35 and the star 43 defines a plurality N of expanding and contracting volume chambers, generally designated 45. The relationship between the rotation angle, $\phi$, of the star 43 about its center and the orbit angle, $\beta$, of the star 43 about the center of the ring assembly 35 is given by the following rotation angle equation 46:

$$\phi(t) = -\left(\frac{1}{N-1}\right) \times \beta(t) \tag{46}$$

where $\phi(t)$ is the rotation angle of the star 43 about its center at sample time t, N is the number of volume chambers 45, and $\beta(t)$ is the orbit angle of the star 43 about the center of the ring assembly 35 at sample time t. In the subject embodiment, and by way of example only, the star 43 has six external teeth, while the gerotor displacement mechanism defines seven volume chambers 45. Therefore, for each complete revolution of the star 43 about its center, the star 43 orbits about the center of the ring assembly 35 six times.

The plurality of control valves 15 are also well known in the art and will therefore be described only briefly herein. In the subject embodiment, and by way of example only, each of the plurality of control valves 15 is a two-position, three-way valve, which is independently controllable. However, it will be understood by those skilled in the art that multiple position control valves, including but not limited to three-position, four-way valves, could also be used with the present invention. Each of the plurality of control valves 15 is electronically actuated to provide fluid communication between one of the plurality of volume chambers 45 and either the fluid inlet 25 or the fluid outlet 27 of the system. The electronic actuation is accomplished by the electronic signals 19 generated by the ECU 17, based on the position input value 21 and the desired input parameter 23.

Figure 3:
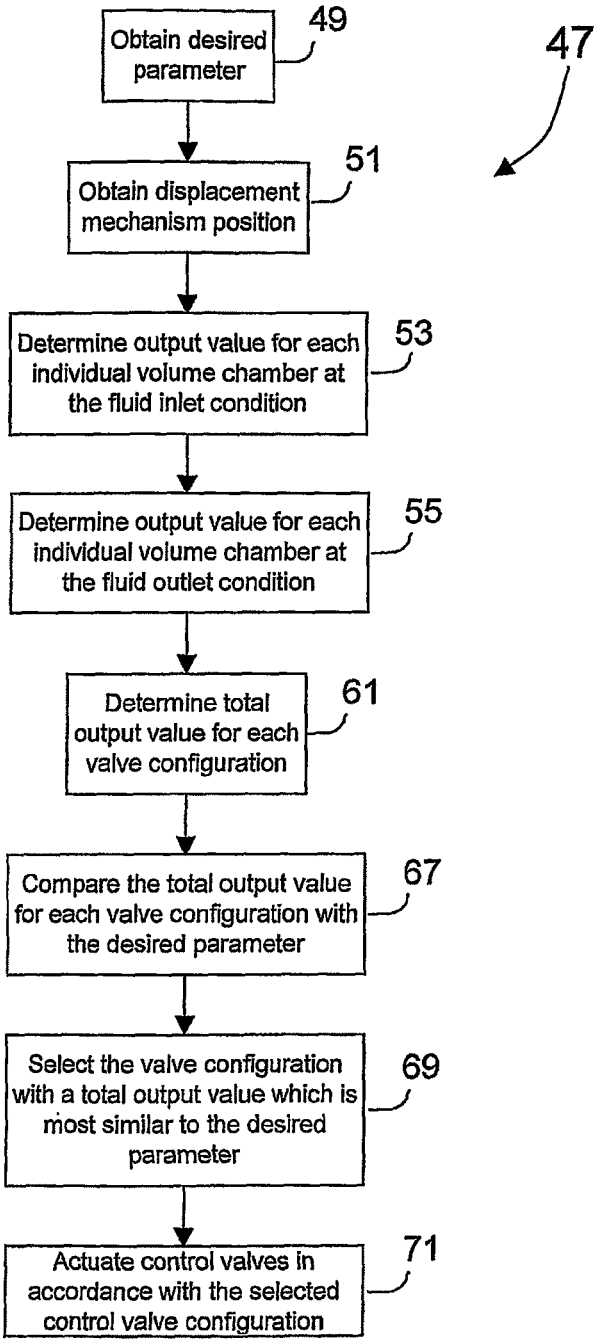
FIG. 3 is a flow diagram of the method in accordance with the present invention.

Referring now to FIGS. 2 and 3, the invention provides a control method 47 that is used by the ECU 17 to control the net-displacement of the fluid displacement mechanism 33 for each of a plurality of sample times t. Using this net-displacement control method 47, the ECU 17 determines which of the volume chambers 45 should be in fluid communication with the fluid inlet 25 and which of the volume chambers 45 should be in fluid communication with the fluid outlet 27 in order to attain the desired input parameter 23 for each sample time t. While the net-displacement control method 47 could be used to control the output torque or the output speed of the fluid motor 13, the net-displacement control method 47 will be described in detail with examples pertaining to the control of the output torque of the fluid motor 13 at one sample time. It will be understood by those skilled in the art that the examples pertaining to the control of the output torque of the fluid motor 13 are merely for illustrative purposes and are not intended to limit the present invention in any way.

At step 49, the ECU 17 receives the desired input parameter 23. The desired input parameter 23 could be generated by various sources, including but not limited to an input controller, such as a joystick, a keyboard, or a computer. At step 51, the ECU 17 receives the position input value 21 of the fluid displacement mechanism 33. In the subject embodiment and by way of example only, the position input value 21 corresponds to the relative position of the star 43 with respect to the ring assembly 35. In fluid motors of the type in which an output shaft (not shown) is coupled to the star 43 through a main drive shaft (not shown), the position input value 21 can be obtained by sensing the position of the output shaft (not shown) of the fluid motor 13 using a shaft encoder. However, as there are various ways in which gerotor position could be sensed, it will be understood by those skilled in the art that the net-displacement control method 47 is not limited to the use of a shaft encoder. It will also be understood by those skilled in the art that the order in which the step 49 is performed relative to step 51 is not critical to the net-displacement control method 47.

Steps 53 and 55 of the net-displacement control method 47 require a determination of an output value for each individual volume chamber 45 evaluated at the fluid conditions of the different fluid sources that may be in fluid communication with the volume chambers 45. In the subject embodiment, and by way of example only, each volume chamber 45 is in fluid communication with pressurized fluid from either the fluid inlet 25 or the fluid outlet 27. Therefore, in the subject embodiment, each volume chamber 45 has two possible output values. By way of example only, the torque output of an individual volume chamber 45 may be computed using the following torque equation 57:

$$T_{jc}(\phi) = P_{jc} \times \frac{dV_{jc}(\phi)}{d\phi} \tag{57}$$

where $T_{jc}(\phi)$ is the instantaneous torque contribution of volume chamber jc at a given rotation angle, $\phi(t)$, of the star 43, $dV_{jc}(\phi)/d\phi$ is the incremental change of volume of chamber jc with respect to the incremental change of rotation angle, $\phi(t)$, of the star 43, and F is the fluid pressure in volume chamber jc. In step 53, the torque equation 57 would be computed with $P_{jc}$ equal to the fluid pressure of the fluid inlet 25, while in step 55, the torque equation 57 would be computed with $P_{jc}$ equal to the fluid pressure of the fluid outlet 27.

While the value of $dV_{jc}(\phi)/d\phi$ could be computed using various approaches, one approach involves the solution of an equation which incorporates information concerning the profile of the star 43. By way of example only, $dV_p(\phi)/d\phi$ can be computed using the following volume equation 59:

$$\begin{aligned}\frac{dV_{jc}(\phi)}{d\phi} = {} & \frac{1}{2}\cdot N\cdot L_M\cdot e_c\cdot r_r\cdot\left\{\cos\left(\beta-\frac{(j_c+1)\cdot 2\pi}{N}\right)-\cos\left(\beta-\frac{j_c\cdot 2\pi}{N}\right)\right\}+ \\ & 2\cdot r_g\left\{\sqrt{N^2\cdot e_c^2+r_r-2\cdot N\cdot e_c\cdot r_r\cdot\cos\left(\beta-\frac{(j_c+1)\cdot 2\pi}{N}\right)}-\right. \\ & \left.\sqrt{N^2\cdot e_c^2+r_r-2\cdot N\cdot e_c\cdot r_r\cdot\cos\left(\beta-\frac{j_c\cdot 2\pi}{N}\right)}\right\}\end{aligned} \tag{59}$$

where $L_M$ is the thickness of the gerotor displacement mechanism 33, $e_c$ is the distance between the center of the star 43 and the center of the ring assembly 35, $r_r$ is the radius of a circle formed through the centers of the rollers 41, and $r_g$ is the radius of the rollers 41. While the volume equation 59 is a theoretical equation based on the above listed parameters, it will be understood by those skilled in the art that the volume equation 59 could be reformulated to account for different parameters. As there are a variety of different equations which could be used to compute the individual contributions of the volume chambers 45, it will be understood by those skilled in the art that the present invention is not limited to the use of the above described equations.

Referring still to FIGS. 2 and 3, at step 61, a total output value at rotation angle, $\phi(t)$, of the star 43 is computed for each of a plurality of control valve configurations 63. Each of the plurality of control valve configurations 63 is unique and contains an actuation position for each of the plurality of control valves 15. In the subject embodiment, and by way of example only, each of the plurality of control valves 15 has two actuation positions, one actuation position provides fluid communication between the fluid inlet 25 and the corresponding volume chamber 45, while the other actuation position provides fluid communication between the corresponding volume chamber 45 and the fluid outlet 27. By way of example only, a table is shown below, which provides an abbreviated sample of the plurality of the control valve configurations 63. In this control valve configuration table, a numeric representation corresponding to the fluid communication between each of the volume chambers 45 and either the fluid inlet 25 or the fluid outlet 27 for each of the plurality of control valves 15 is assigned. The number "1" is used to represent the actuation position of those control valves 15 which are providing fluid communication between the fluid inlet 25 and the volume chamber 45, while the number "0" is used to represent the actuation position of those control valves 15 which are providing fluid communication between the fluid outlet 27 and the volume chamber 45. While only three control valve configurations 63*a*, 63*b*, 63*c* have been shown in the table below, in the subject embodiment, and by way of example only, there would be $2^N$ or 128 possible control valve configurations 63 since each control valve 15 may provide fluid communication to each of the volume chambers 45 from two (2) possible sources, the fluid inlet 25 or the fluid outlet 27, and there are seven volume chambers 45 (N=7). However, since the control valve configuration 63 in which all of the control valves 15 are connected to fluid inlet 25 and the control valve configuration in which all of the control valves 15 are connected to fluid outlet 27 would yield the same total output value, there are 127 unique total output values available. The total output value for each of the plurality control valve configurations 63 can be computed by summing the output value associated with each of the plurality of volume chambers 45 at the fluid condition of the fluid source which is in communication with each volume chamber 45 as defined in the control valve configuration 63. By way of example only, the total output value for the control of the output torque of the fluid motor 13, hereinafter referred to as the "total output torque", at a given rotation angle, $\phi(t)$, of the star 43 can be computed using the following total output torque equation 65 for each of the plurality of control valve configurations 63:

$$T_m(\phi) = \sum_{jc=1}^{N} T_{jc}(\phi). \tag{65}$$

Therefore, in the subject embodiment, and by way of example only, the total output torque for control valve configuration 63*a* (shown in the table below) would be computed by adding the following output values together: (1) the output value of the volume chamber 45*a*, which is associated with control valve 15*a*, at fluid outlet conditions; (2) the output value of the volume chamber 45*b*, which is associated with control valve 15*b*, at fluid inlet conditions; (3) the output value of the volume chamber 45*c*, which is associated with control valve 15*c*, at fluid inlet conditions; (4) the output value of the volume chamber 45*d*, which is associated with control valve 15*d*, at fluid outlet conditions; (5) the output value of the volume chamber 45*e*, which is associated with control valve 15*e*, at fluid outlet conditions; (6) the output value of the volume chamber 45*f*, which is associated with control valve

Figure 4:
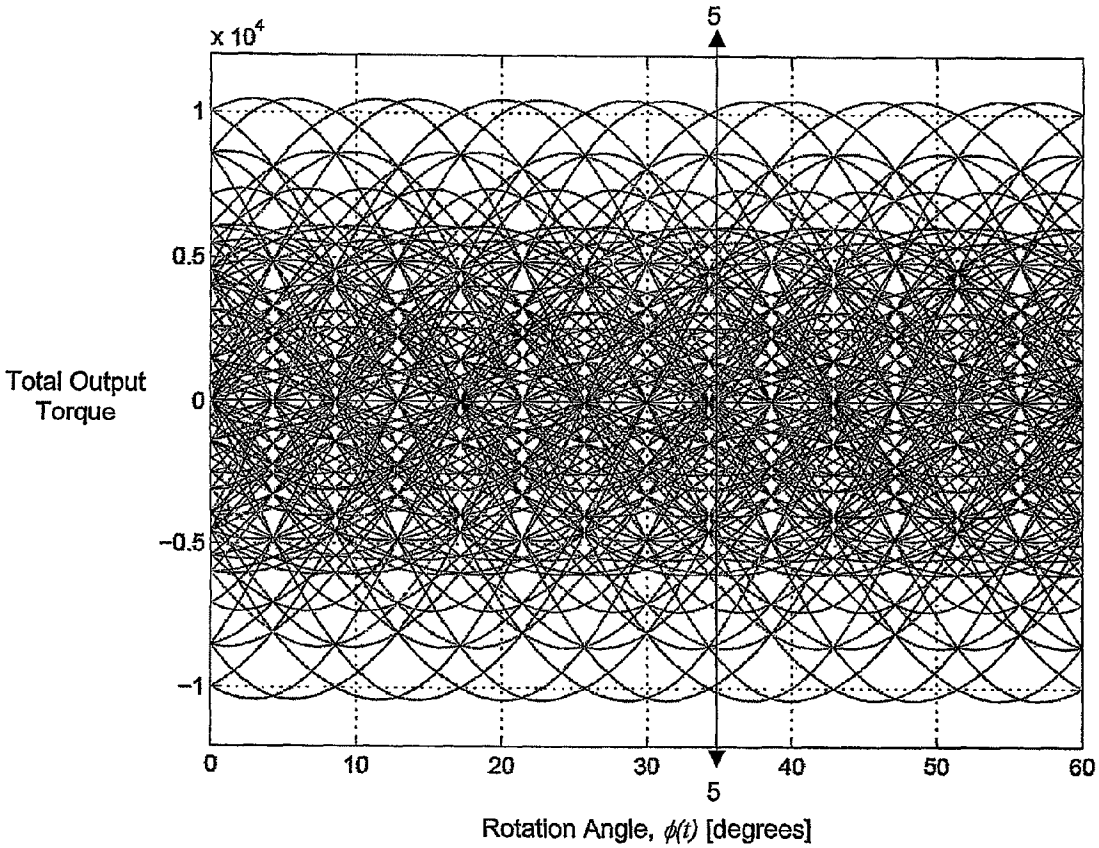
FIG. 4 is a plot illustrating the total output torque values of the subject embodiment versus the rotation angle of the star.

15*f*, at fluid inlet conditions; and (7) the output value of the volume chamber 45*g*, which is associated with control valve 15*g*, at fluid outlet conditions. FIG. 4 illustrates a graph of the total output torque of the fluid motor 13 for each of the plurality of control valve configurations 63 versus the rotation angle, ϕ(t), of the star 43. It will be understood by those skilled in the art, however, that the graph in FIG. 4 is provided merely for illustrative purposes and will change based on changes to various parameters including but not limited to the profile of the star 43, the possible sources of fluid, and the number of control valves 15.

| | Control Valve Configurations 63 | | | | | | | |
|---|---|---|---|---|---|---|---|---|
| Ref. | 15a | 15b | 15c | 15d | 15e | 15f | 15g | $T_m$ (ϕ) |
| 63a | 0 | 1 | 1 | 1 | 0 | 1 | 0 | 5,762 |
| 63b | 0 | 1 | 1 | 1 | 0 | 0 | 1 | 5,990 |
| 63c | 1 | 0 | 1 | 1 | 0 | 0 | 0 | 6,051 |

Figure 5:
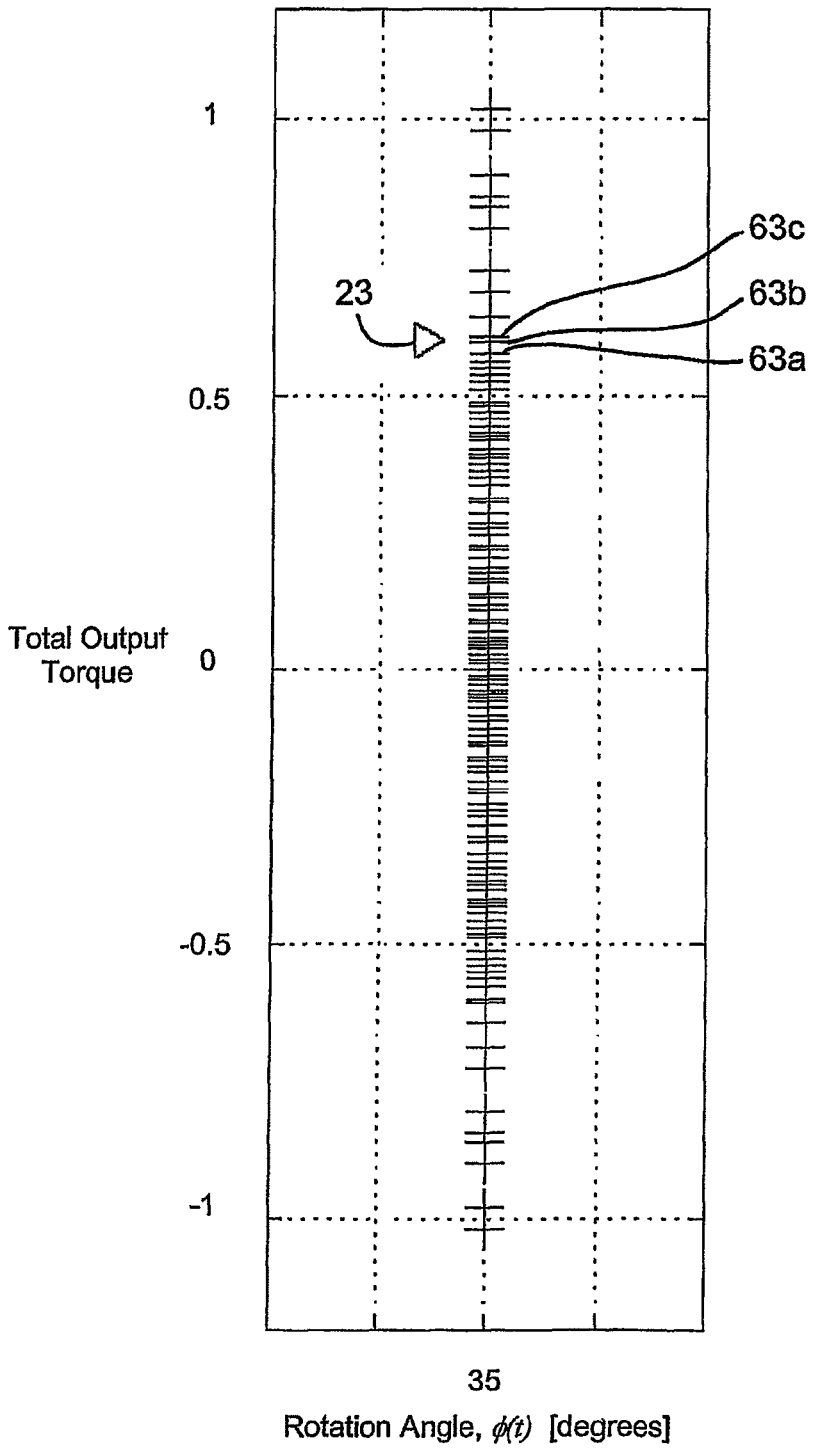
FIG. 5 is a plot illustrating the total output torque values of the subject embodiment at a rotation angle of the star taken on line 5-5 of FIG. 4

Referring again to FIGS. 2 and 3, at step 67 of the net-displacement control method 47, a comparison is made between the total output values for each of the plurality of control valve configurations 63 and the desired input parameter 23. At step 69, the control valve configuration 63 with a minimum difference between the corresponding total output value and the desired input parameter 23 is selected for that particular rotation angle, ϕ(t), of the star 43 at sample time t. At step 71, the ECU 17 actuates the control valves 15 in accordance with the selected control valve configuration 63. By way of example only, FIG. 5 is a graph of the total output torque values corresponding to a particular rotation angle, ϕ(t), of the star 43 of 35 degrees. The desired input parameter 23 is shown on the graph as a triangle. The total output torque values corresponding to the control valve configurations 63*a*, 63*b*, 63*c* from the table above, are also shown in FIG. 5. If the desired input parameter 23 is 6,000 in-lbs, then a comparison would be made between this desired input parameter 23 and the total output torque for each of the plurality of control valve configurations. In the present example, the control valve configuration 63*b* corresponds to the total output torque which is most similar to the desired input parameter 23. With the control valve configuration 63*b* selected, the ECU 17 sends electrical signals 19*a*, 19*b*, 19*c*, 19*d*, 19*e*, 19*f*, 19*g* to the control valves 15*a*, 15*b*, 15*c*, 15*d*, 15*e*, 15*f*, 15*g*, respectively in accordance with the control valve configuration 63*b*. Therefore, in the present example, the ECU 17 would send electrical signals 19*b*, 19*c*, 19*d*, and 19*g* to actuate the control valves 15*b*, 15*c*, 15*d*, and 15*g* such that the volume chambers 45*b*, 45*c*, 45*d*, and 45*g* are in fluid communication with the fluid inlet 25. The ECU 17 would also send electrical signals 19*a*, 19*e*, and 19*f* to actuate the control valves 15*a*, 15*e*, and 15*f* such that the volume chambers 45*a*, 45*e*, and 45*f* are in fluid communication with the fluid outlet 27.

Figure 6:
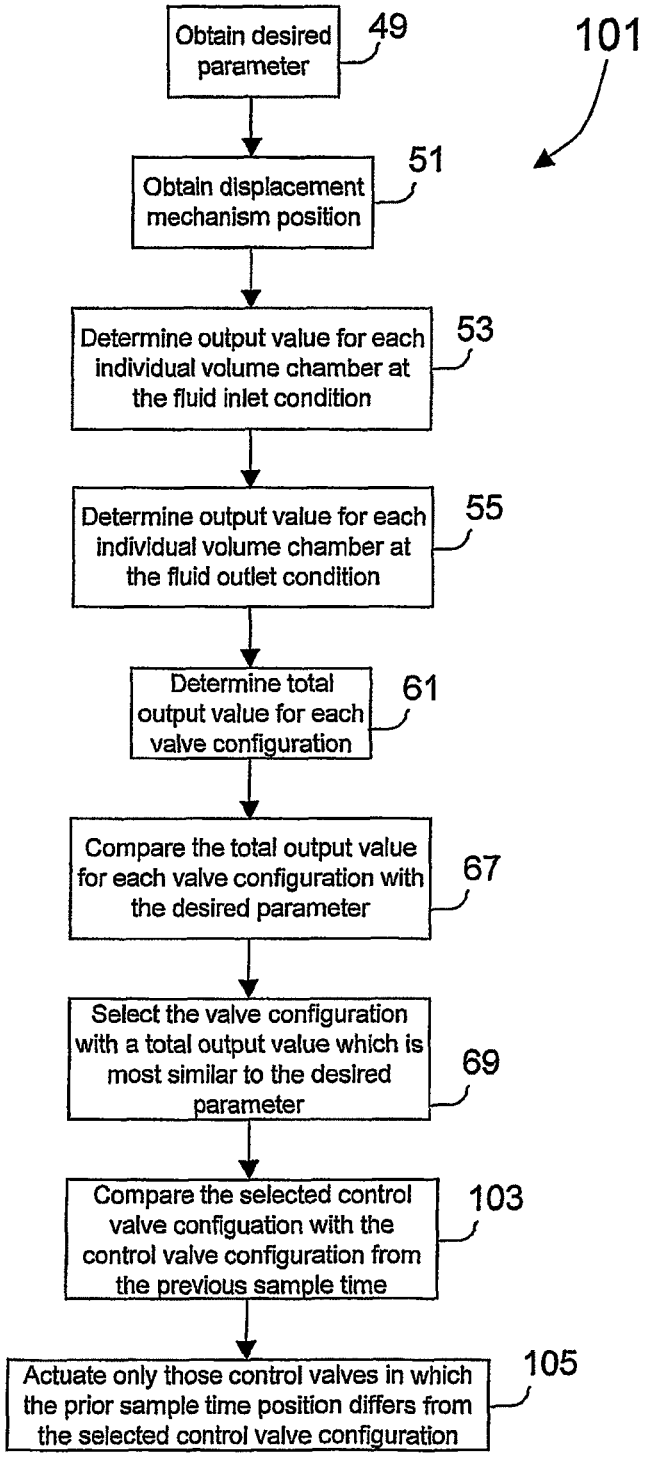
FIG. 6 is a flow diagram of an alternate method in accordance with the present invention.

Referring now to FIGS. 2 and 6, an alternative net-displacement control method 101 is provided which would require less electrical energy for the switching of the control valves 15 than the net-displacement control method 47, because in this alternative net-displacement control method 101, not all of the control valves 15 necessarily need to be actuated. This alternative net-displacement control method 101 would be used with control valves 15 of the latch valve type. In the alternative net-displacement control method 101, method steps which are the same as those in the net-displacement control method 47 will have the same reference number and will not be further described. Those method steps which are different, however, shall have reference numerals in excess of "100" and shall be described in detail.

In the alternative net-displacement control method 101, after the control valve configuration 63 has been selected in step 69, the selected control valve configuration 63 is compared to the control valve configuration 63 of the previous sample time in step 103. At step 105, the ECU 17 actuates only those control valves 15 of which the position from the previous sample time differs from the position from the selected control valve configuration 63. By way of example only, assume the control valve configuration 63 from the previous time step required control valves 15*b*, 15*c*, 15*d*, and 15*g* to provide fluid communication between the fluid inlet 25 and the volume chambers 45*b*, 45*c*, 45*d*, and 45*g*, and control valves 15*a*, 15*e*, and 15*f* to provide fluid communication between the volume chambers 45*a*, 45*e*, and 45*f* and the fluid outlet 27. If the control valve configuration of the current sample time required control valves 15*c*, 15*d*, 15*e*, and 15*g* to provide fluid communication between the fluid inlet 25 and the volume chambers 45*c*, 45*d*, 45*e*, and 45*g* and control valves 15*a*, 15*b*, and 15*f* to provide fluid communication between the volume chambers 45*a*, 45*b*, and 45*f* and the fluid outlet 27, then the ECU 17 would only send electrical signals 19*b* and 19*e* to control valves 15*b* and 15*e*. In other words, in the example above, the ECU 17 would only send the electrical signals 19 to those control valves 15 that are currently required to provide fluid communication to the volume chambers 45 from a fluid source that is different than the fluid source from the previous sample time.

While the computing power of high performance ECUs could evaluate the net-displacement control methods 47, 101 at high sample time rates, the computing power of standard industrial ECUs may not be able to accommodate those high rates. Therefore, it is desirable to have an alternative net-displacement control method 201 which can be used within the computing power of standard industrial ECUs.

Figure 7:
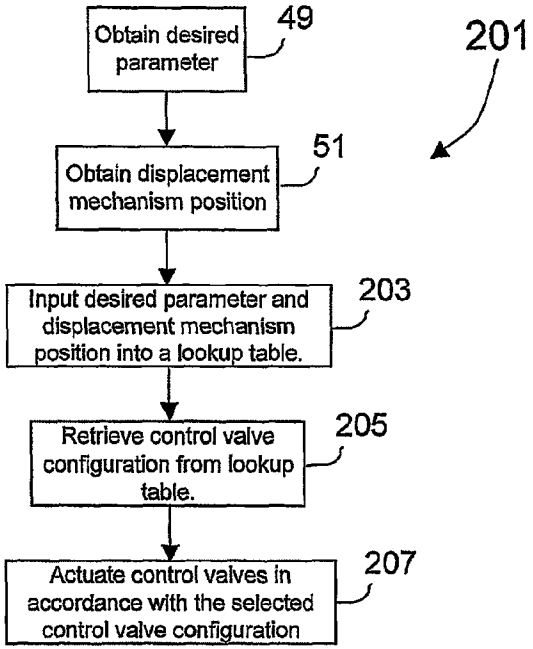
FIG. 7 is a flow diagram of an alternate method in accordance with the present invention.

Referring now to FIGS. 2 and 7, an alternative net-displacement control method 201 used by the ECU 17 at each sample time t to control the net-displacement of the fluid displacement mechanism 33 is provided. In the alternative net-displacement control method 201, method steps which are the same as those in the net-displacement control method 47 will have the same reference number and will not be further described. Those method steps which are different, however, shall have reference numerals in excess of "200" and shall be described in detail.

At step 203, the desired input parameter 23 and the position input value 21 obtained at steps 49 and 51 are inputted into a control valve configuration lookup table. The control valve configuration lookup table would contain similar information contained in FIG. 4 except in table format. At step 205, the control valve configuration 63, which most closely corresponds to the desired input parameter 23 and the position input value 21, is retrieved. At step 207, the ECU 17 actuates the control valves 15 in accordance with the retrieved control valve configuration 63.

Figure 8:
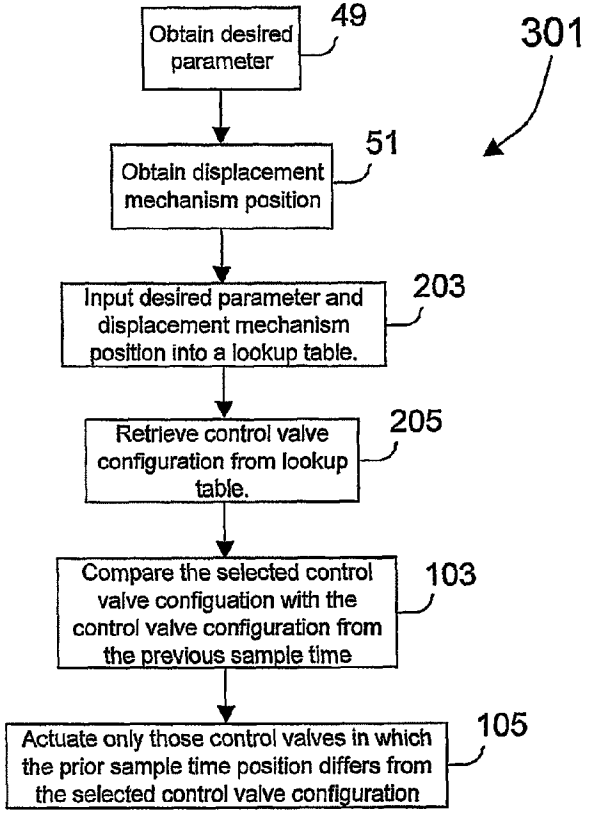
FIG. 8 is a flow diagram of an alternate method in accordance with the present invention.

Referring now to FIGS. 2 and 8, an alternative net-displacement control method 301 is provided which would require less electrical energy for the switching of the control valves 15 than the net-displacement control method 201, because in this alternative net-displacement control method 301, not all of the control valves 15 necessarily need to be actuated. This alternative net-displacement control method 301 would be used with control valves 15 of the latch valve type. In the alternative net-displacement control method 301, method steps which are the same as method steps which have been previously described will have the same reference numerals.

In the alternative net-displacement control method 301, after the control valve configuration 63 has been retrieved in step 205, the selected control valve configuration 63 is compared to the control valve configuration 63 of the previous sample time in step 103. At step 105, the ECU 17 actuates only those control valves 15 in which the position of the control valve 15 from the previous sample time differs from the position of the control valve 15 from the selected control valve configuration 63.

While the previously described net-displacement control methods 47, 101, 201, 301 will effectively control the net-displacement of the rotary fluid pressure device 13 during low-speed operation, many of the control valve configurations 63 provided in those previously described net-displacement control methods 47, 101, 201, 301 may not be as effective during high-speed operation of the rotary fluid pressure device 13. In the previously described net-displacement control methods 47, 101, 201, 301, many of the unique control valve configurations 63 provide for the supply of fluid at fluid outlet conditions to expanding volume chambers 45 of the fluid displacement mechanism 33. During high-speed operation of the rotary fluid pressure device 13, these control valve configurations 63, which supply fluid at fluid outlet conditions to expanding volume chambers 45, may cause cavitation in those expanding volume chambers 45 and potentially result in mechanical damage to the fluid displacement mechanism 33. This risk of cavitation in the expanding volume chambers 45 of the fluid displacement mechanism 33 could be significantly reduced, however, by only supplying fluid at the fluid inlet condition to the expanding volume chambers 45. Therefore, a high-speed net-displacement control method 401 shall be subsequently described which will control the high-speed operation of the rotary fluid pressure device 13. In this high-speed net-displacement control method 401, method steps which are the same as those in the previously described net-displacement control methods 47, 101, 201, 301 will have the same reference number and will not be further described. Those method steps which are different, however, shall have reference numerals in excess of "400" and shall be described in detail.

Figure 9:
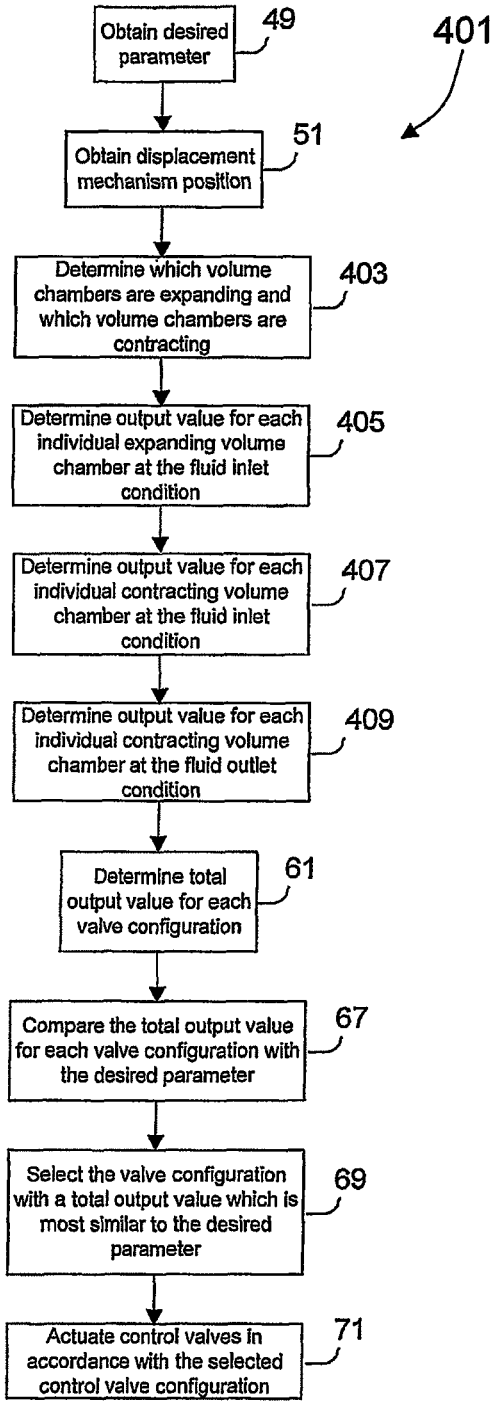
FIG. 9 is a flow diagram of a method in accordance with the present invention.

Referring now to FIGS. 2 and 9, in steps 49 and 51 of the high-speed net-displacement control method 401, the desired input parameter 23 and the position input value 21 are obtained. As in the previously described net-displacement control methods 47, 101, 201, and 301, the order in which steps 49 and 51 are performed is not critical to the high-speed net-displacement control method 401.

In step 403, a determination is made as to which volume chambers 45 of the fluid displacement mechanism 33 are expanding and which volume chambers 45 are contracting (referred to hereinafter and in the appended claims as "an expansion state" of the plurality of volume chambers 45). As is well known to those skilled in the art, there are a variety of approaches to determining the expansion state of each of the plurality of volume chambers 45. One such approach to making this determination, by way of example only, is to evaluate the instantaneous rate of change in volume, dV/dt, for each of the plurality of volume chambers 45. An expanding volume chamber 45 is defined as a volume chamber 45 in which the instantaneous rate of change in volume is greater than zero, dV/dt>0. Another approach, by way of example only, would be to input the position input value 21 and a direction of rotation of the rotary fluid pressure device 13 in a lookup table, which would provide the expansion state of each of the plurality of volume chambers 45 based on these inputs. It will be understood by those skilled in the art that since there are a variety of approaches that could be used to determine the expansion state of the plurality of volume chambers 45, the present invention is not limited to the approaches described above.

In step 405, the output value for each individual expanding volume chamber 45 is determined only at fluid inlet conditions. Steps 407 and 409 are very similar to steps 53 and 55 of the net-displacement control method 47, except that in steps 407 and 409, the output values are determined for the contracting volume chambers 45 only. It will be understood by those skilled in the art that the order in which steps 405, 407, and 409 are performed is not critical to the high-speed net-displacement control method 401.

Since the remaining steps in this high-speed net-displacement control method 401, which are shown in FIG. 9, are similar to those described in the net-displacement control method 47, these remaining steps will not be further described herein. However, one important distinction between the remaining steps in the high-speed net-displacement control method 401 and those in the net-displacement control method 47 is that the total number of control valve configurations 463 in the high-speed net-displacement control method 401 is significantly less than the total number of control valve configurations 63 in the net-displacement control method 47. The reason for this decrease in the total number of control valve configurations 463 between the high-speed net-displacement control method 401 and the net-displacement control method 47 is that all expanding volume chambers 45 in the high-speed net-displacement control method 401 are only supplied with fluid at fluid inlet conditions. The control valve configurations 63 of the net-displacement control method 47, on the other hand, allow for the expanding volume chambers 45 to be supplied with fluid at either fluid inlet or fluid outlet conditions. In the subject embodiment, and by way of example only, the number of possible control valve configurations 463 for the high-speed net-displacement control method 401 is equal to $2^{Nc}+2^{N-Nc}$, where $N_c$ is the number of contracting volume chambers 45 and N is the total number of volume chambers 45. In the subject embodiment, and by way of example only, when the number of volume chambers 45 is equal to seven (N=7) and the number of contracting volume chambers 45 is equal to three or four ($N_c$=3 or 4), there would be 24 possible control valve configurations 463. (It is well known to those skilled in the art of gerotor displacement mechanisms 33 that when the gerotor displacement mechanism 33 has seven volume chambers 45, the number of contracting volume chambers 45 can be either three or four depending on the orientation of the star 43 relative to the ring assembly 35. However, as the above equation demonstrates, the number of possible control valve configurations 463 is still 24, regardless of whether the number of contracting volume chambers 45 is three or four.) As previously stated, the 24 possible control valve configurations 463, as calculated above, is significantly less than the 127 unique control valve configurations 63 associated with the net-displacement control method 47.

Figure 10:
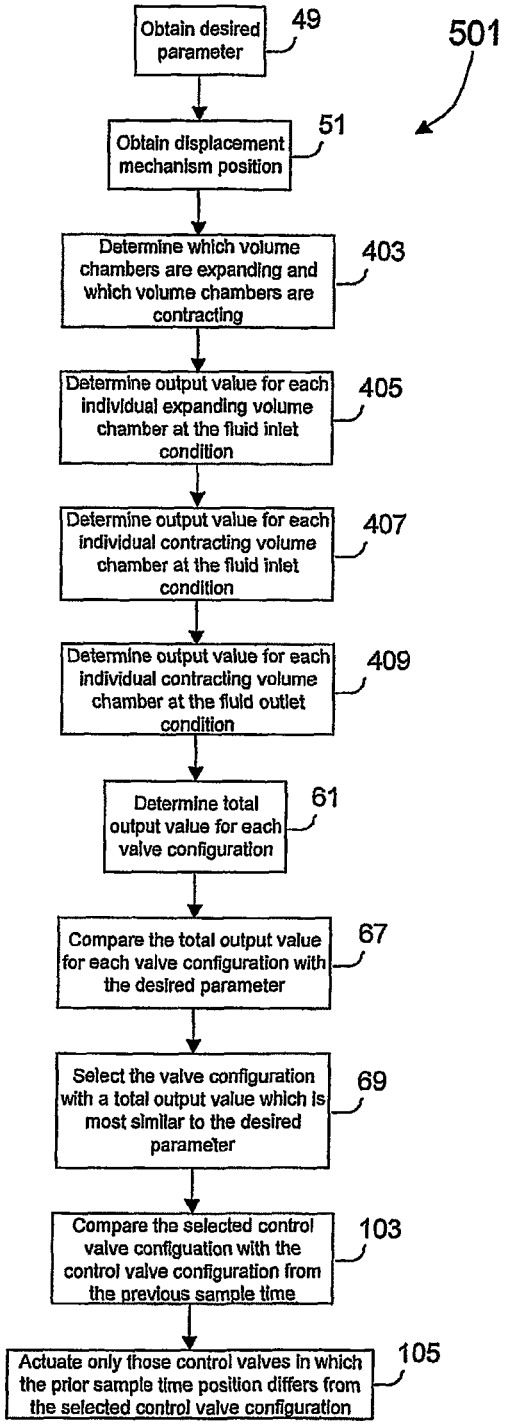
FIG. 10 is a flow diagram of an alternate method in accordance with the present invention.

Referring now to FIG. 10, an alternative high-speed net-displacement control method 501 is provided which would require less electrical energy for the switching of the control valves 15 than the high-speed net-displacement control method 401, because in this alternative high-speed net-displacement control method 501, not all of the control valves 15 necessarily need to be actuated. This alternative high-speed net-displacement control method 501 would be used with control valves 15 of the latch valve type. Since all of the steps associated with this alternative high-speed net-displacement control method 501, as shown in FIG. 10, have been described in detail in the net-displacement control method 47, the alternative net-displacement control method 101, and the high-speed net-displacement control method 401, these steps will not be described in any further detail.

Referring now to FIGS. 7 and 8, the alternative net-displacement control methods 201, 301 could also be applied to the rotary fluid pressure device 13 operating at high-speed. In order to provide effective high-speed control the rotary fluid pressure device 13 and also reduce the risk of cavitation in the expanding volume chambers 45 of the fluid displacement mechanism 33, the only additional requirement of the alternative net-displacement control methods 201, 301 is that the control valve configurations 463 provided in the control valve configuration lookup table should allow the expanding volume chambers 45 to be supplied with fluid at fluid inlet conditions only.

The net-displacement control methods 47, 101, 201, 301, 401, 501 which have been described above in detail, utilize the rotation angle, $\phi(t)$, of the star 43 as determined at the current sample time t. Therefore, the selected control valve configuration 63, which was also described above in detail, is based on this current time step t. However, this selected control valve configuration 63 does not account for the rotation of the star 43 which will occur during the time interval between the current sample time t and the next sample time. If the interval between subsequent sample times is significant, a rapid divergence of the total output value from the desired input parameter 23 could result since the selected control valve configuration 63 did not account for this interval. In order to minimize this rapid divergence, it may be advantageous to utilize the net-displacement control methods 47, 101, 201, 301, 401, 501 in regard to a predicted rotation angle, $\phi_p(t)$, of the star 43, which is determined at some time interval between the current sample time t and the next sample time, rather than the measured rotation angle, $\phi(t)$, of the star 43 at the current sample time t. The predicted rotation angle, $\phi_p(t)$, of the star 43 can be computed using the following predicted rotation angle equation 603:

$$\phi_p(t)+k\cdot\omega\cdot\Delta t \tag{603}$$

where $\phi(t)$ is the rotation angle of the star 43 at the current sample time t, $\omega$ is the angular velocity of the star 43, $\Delta t$ is the time interval between the current sample time and the previous sample time, and k is a sample time prediction constant between 0 and 1. By way of example only, in order to predict the rotation angle, $\phi_p(t)$, of the star 43 at a sample time which is one half of the interval between the current sample time and the next sample time, k would equal ½. As there are a variety of different equations which could be used to predict the rotation angle, $\phi_p(t)$, of the star 43, it will be understood by those skilled in the art that the present invention is not limited to the use of the above described equations.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed:

1. A method for controlling the net-displacement of a fluid device, the method comprising:

obtaining a desired input parameter;

determining a relative position of a first member and a second member of a fluid displacement assembly, wherein the first member and the second member have relative movement and define a plurality of volume chambers that expand or contract in response to the relative movement;

determining a first output value for each of the plurality of volume chambers, with the first output value being based on the relative position and each of the plurality of volume chambers being supplied with fluid at a first fluid pressure;

determining a second output value for each of the plurality of volume chambers, with the second output value being based on the relative position and each of the plurality of volume chambers being supplied with fluid at a second fluid pressure;

calculating a total output value for each of a plurality of control valve configurations;

selecting one of the control valve configurations where the total output value of the control valve configuration most closely equals the desired input parameter; and actuating a plurality of control valves in accordance with said selected control valve configuration, wherein the plurality of control valves are in fluid communication with the plurality of volume chambers.

2. A method of controlling the net-displacement of a fluid device as claimed in claim 1, wherein the relative position is determined at a present sample time.

3. A method of controlling the net-displacement of a fluid device as claimed in claim 1, wherein the relative position is a predicted relative position of the first member and the second member evaluated at a time interval between a present sample time and a subsequent sample time.

4. A method of controlling the net-displacement of a fluid device as claimed in claim 1, wherein actuating the plurality of control valves comprises actuating each of the plurality of control valves.

5. A method of controlling the net-displacement of a fluid device as claimed in claim 1, wherein the fluid device is selected from the group consisting of a fluid motor or fluid pump.

6. A method of controlling the net-displacement of a fluid device as claimed in claim 1, wherein the first fluid pressure most closely equals a fluid pressure at a fluid inlet of the fluid device.

7. A method of controlling the net-displacement of a fluid device as claimed in claim 6, wherein the second fluid pressure most closely equals a fluid pressure at a fluid outlet of the fluid device.

* * * * *